US009267313B2

(12) United States Patent
Frison et al.

(10) Patent No.: US 9,267,313 B2
(45) Date of Patent: Feb. 23, 2016

(54) ANTI-TIP CLOSURE DEVICE FOR DRAWER CABINET

(71) Applicant: FAMI S.R.L., Rosa' (IT)

(72) Inventors: Lorenzo Frison, Fontaniva (IT); Giuseppe Tosin, Bassano del Grappa (IT)

(73) Assignee: FAMI S.R.L., Rosa' (IT)

( * ) Notice: Subject to any disclaimer, the term of this patent is extended or adjusted under 35 U.S.C. 154(b) by 0 days.

(21) Appl. No.: 14/288,010

(22) Filed: May 27, 2014

(65) Prior Publication Data

US 2014/0354121 A1 Dec. 4, 2014

(30) Foreign Application Priority Data

May 28, 2013 (IT) ..... MO2013A0150

(51) Int. Cl.
*E05B 65/46* (2006.01)
*E05B 63/00* (2006.01)

(52) U.S. Cl.
CPC ..... *E05B 65/463* (2013.01); *E05B 65/464* (2013.01); *E05B 63/0056* (2013.01)

(58) Field of Classification Search
CPC ... E05B 65/463; E05B 65/464; E05B 65/462; E05B 65/46; E05B 65/465; E05B 63/0056; A47B 88/04
USPC ..... 312/215–219, 221, 222
See application file for complete search history.

(56) References Cited

U.S. PATENT DOCUMENTS 4,957,334 A 9/1990 Lakso
5,599,078 A * 2/1997 Dechene et al. ..... 312/221
5,634,701 A 6/1997 Hendrich et al.
5,772,294 A 6/1998 Hendrich et al.
5,782,545 A * 7/1998 Kahara et al. ..... 312/217
5,931,548 A * 8/1999 Bischoff ..... 312/221
5,988,778 A 11/1999 Lammens
5,997,114 A * 12/1999 Bischoff ..... 312/215
6,296,332 B1 * 10/2001 Lammens ..... 312/217
6,450,596 B1 * 9/2002 Lee ..... 312/217
7,144,092 B1 * 12/2006 Chang ..... 312/217
8,287,057 B2 * 10/2012 Sevillano Gil ..... 312/221

(Continued)

FOREIGN PATENT DOCUMENTS

EP 2 053 187 A1 4/2009

*Primary Examiner* — Janet M Wilkens
*Assistant Examiner* — Hiwot Tefera
(74) *Attorney, Agent, or Firm* — Pearne & Gordon LLP

(57) ABSTRACT

A closure device for a drawer cabinet, comprising a linear guide (2), activating pins (7) attachable to respective drawers (102), a plurality of cam elements (6) slidably coupled to the guide (2) and stacked along the guide (2), each of said cam elements (6) to receive a translation movement along the guide (2) following a movement of the activating pins (7), a plurality of spacing elements (10) cooperating with the cam elements (6) and each of the spacing elements being movable between an operating position, in which it is arranged between two respective cam elements (6) keeping the two cam elements (6) spaced apart from each other, and an inoperative position, wherein there is movement away from a zone of mutual contact between the two respective cam elements (6) to allow a movement towards each other between the two respective cam elements (6). The spacing elements (10) are made in the form of an elastically deformable metal tongue and are stably and removably anchored to respective receiving portions (12) of the guide (2).

15 Claims, 10 Drawing Sheets

(56) References Cited

U.S. PATENT DOCUMENTS

| | | | | |
|---|---|---|---|---|
| 8,696,074 | B2 * | 4/2014 | Romaen et al. | 312/221 |
| 8,899,699 | B2 * | 12/2014 | Fulterer | 312/221 |
| 9,068,378 | B2 * | 6/2015 | Milani | E05B 43/00 |
| 2004/0130246 | A1 * | 7/2004 | Dube et al. | 312/221 |
| 2008/0074017 | A1 * | 3/2008 | Ruan et al. | 312/221 |
| 2010/0123375 | A1 * | 5/2010 | Romaen et al. | 312/215 |
| 2011/0005283 | A1 * | 1/2011 | Sevillano Gil | E05B 65/464 70/85 |
| 2012/0242201 | A1 * | 9/2012 | Fulterer | E05B 65/464 312/218 |
| 2014/0167575 | A1 * | 6/2014 | Freimuth | 312/220 |
| 2014/0265761 | A1 * | 9/2014 | Ropele | 312/218 |
| 2014/0361668 | A1 * | 12/2014 | Fulterer | 312/218 |

* cited by examiner

ANTI-TIP CLOSURE DEVICE FOR DRAWER CABINET

The present invention has as its subject an anti-tip device for drawer cabinets and a drawer cabinet equipped with such a closure device. Drawers are known controlled by a centralized lock which determines the possibility of pulling out one drawer at a time by means of a mechanism with superimposed cams which, in an opening configuration, can translate upwards through a movement sufficient to allow the passage of a pin attached to a drawer.

Mechanisms of this type are known for example from US2011/005283 or US2012/0242201 and are configured in such a way as to reach an opening position wherein it is permitted to lift a cam (together with the stack of cams above it) to enable the pin on the drawer to pass and thus to open a drawer, and a closure position wherein lifting a cam (and the cams above it), corresponding to the above-mentioned upwards movement necessary for opening a drawer, is prevented.

In US2011/005283, each cam has a slider translating vertically inside a vertical profiled element under the thrusting action of a pin of a drawer, and an engagement element pivoted on the slider to bring about, during opening (wherein the pin of the drawer is withdrawn with respect to the closure position), a stable position of lifting the cam with respect to the cam below. In other words the engagement element forms a spacer element which keeps the cam lifted with respect to the cam below in an opening position of the corresponding drawer. This lifting, having a magnitude substantially equal to the diameter of the pin, keeps the cam lifted together with the cams above it in such a way that the top cam, in cooperation with a stop element, does not allow a further lifting and therefore the opening of a further drawer.

In US2012/0242201, each cam translates vertically inside a vertical profiled element and is conformed in such a way as to be rotatable between a first position, of maximum height, wherein it defines a lifting of itself and of the cams above it with respect to the cam below (in case of opening a drawer) and a second position, rotated with respect to the first position, of minimum height, corresponding to a closure position of the relative drawer. In one embodiment, the cams not affected by the pins of the relative drawers can be replaced by elements of elongated shape interposed between two cams.

The Applicant has found that the solutions set forth above have certain drawbacks.

In particular the manufacture of the cams is very complex since each of them must allow a rotational connection between the slider and the engagement element and must furthermore allow the engagement element to arrange itself in two stable positions of different heights in order to be able to lock the cams above it in a lifted position suitable for preventing the opening of further drawers besides the one which is currently open, or to release the cams and return them to the "packed" configuration.

Furthermore, where, (as generally occurs) the height (substantially coinciding with the pitch) of a cam is lower (and in particular a submultiple) of the height of the drawers, it follows that some of the cams are unused because they are not associated with any pin for activating the drawers, with a useless increase in the cost of manufacture due to the use of components not strictly necessary.

Alternatively, in accordance with the alternative solution described in US2012/0242201, in the event that substitute elements of elongated shape are used which replace the unused cams, the result in any case is a final configuration not easily adaptable according to needs. The use of elements of elongated shape, translatable and not rotatable and anyway not suitable for interacting with the pins of the drawers, prevents a modification of the configuration of the drawers without a complex substitution or redistribution of the sliding elements inside the profiled element. And furthermore, in addition to the above, it is necessary in this case to hold different types of elements in stock (for example elongated elements of different lengths), with obvious logistical complications.

The technical task of the present invention is therefore to make available a closure device for drawer cabinets which overcomes the drawbacks of the known art complained of above.

In particular, an object of the present invention is to make available a closure device for drawer cabinets which is constructionally simple.

It is furthermore an object of the present invention is to make available a closure device for drawer cabinets which entails reduced production costs.

It is furthermore an object of the present invention is to make available a closure device for drawer cabinets which has a high degree of flexibility in use, in particular which is adaptable simply and rapidly to different situations and needs.

A drawer cabinet equipped with said closure device furthermore forms a subject of the present invention.

The technical characteristics of the invention, according to the aforementioned object, can be clearly seen from the contents of the claims set forth below, and the advantages thereof will more fully emerge from the detailed description which follows, made with reference to the accompanying drawings, which represent a purely exemplary and non-limiting embodiment thereof, wherein:

Figure 1:
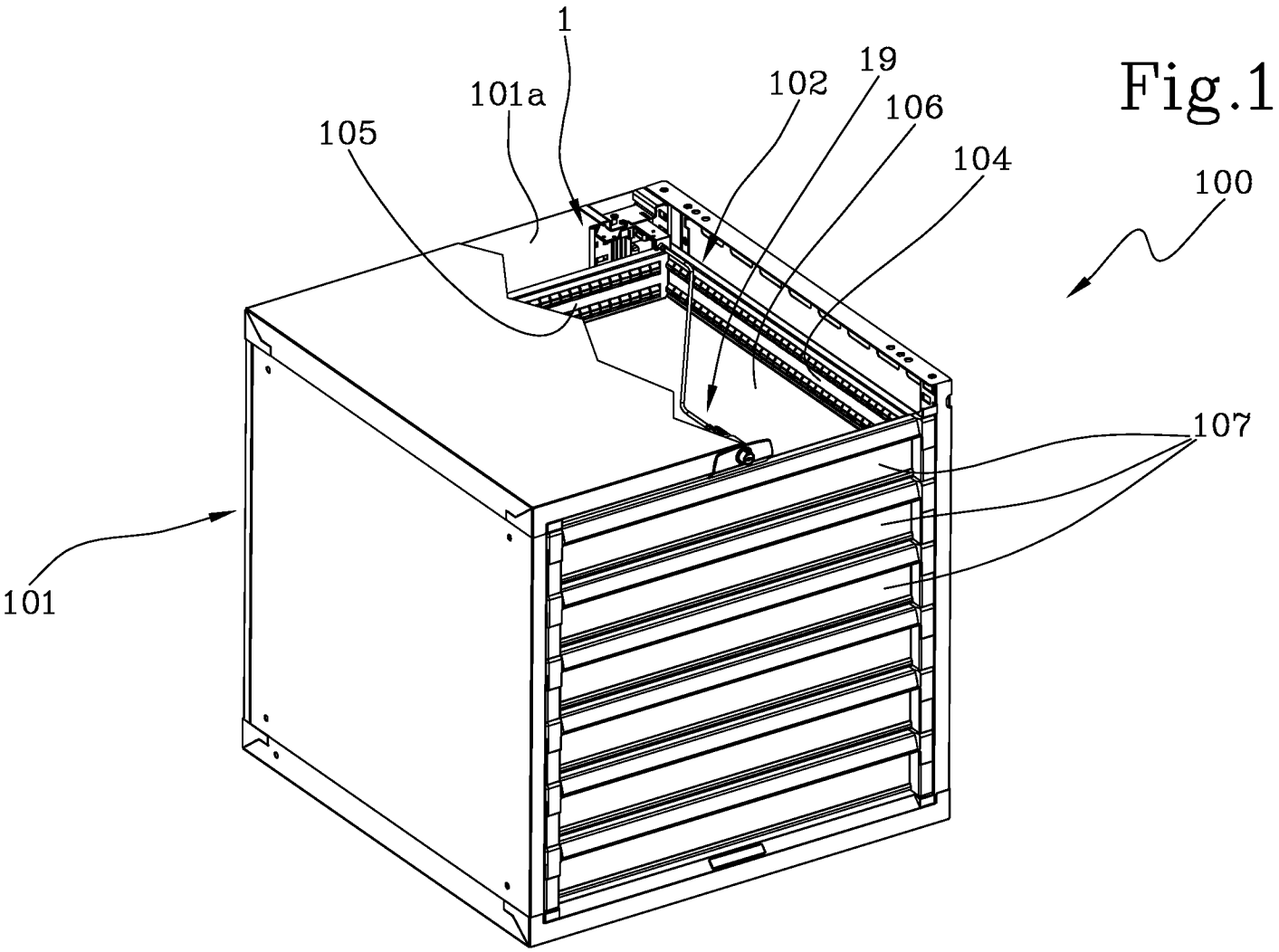
FIG. 1 shows a view partially in section of a drawer cabinet equipped with a closure device according to the present invention.

With reference to the accompanying drawings, no. 100 comprehensively represents a drawer cabinet of the type comprising a support structure 101 equipped with a plurality of drawers 102 vertically stacked on each other". The term "stacked" is intended also to mean a configuration in which the drawers are spaced apart from each other, for example by the interposition of fixed parts or other items.

Within the scope of the present invention the term "drawer cabinet" is intended to mean any structure (cabinet, frame, shelving etc.) provided with drawers which may lie in any arrangement (drawers arranged horizontally or vertically, and horizontally slidable). This term furthermore comprises technical solution with drawers on view or covered by one or more doors, hinged or of yet other type.

The drawers 102 are slidably attached along respective guides 103 which define respective horizontal sliding paths.

In the embodiment illustrated, each drawer has a pair of opposed side walls 104 (only one of which is visible in FIG. 1), a rear wall 105 and a bottom panel 106, besides a front 107 on which suitable gripping means may be provided to facilitate the drawer 102 being pulled out by a user.

The cabinet 100 comprises furthermore a closure device 1 which is responsible for allowing or preventing the opening of one drawer 102 at a time. In greater detail, the closure device 1 makes it possible to achieve the following configurations:

- a first configuration suitable for allowing the opening of a single drawer 102 at a time (irrespective of which drawer is actually opened); and
- a second configuration suitable for preventing the opening of each drawer 102, thus effecting complete closure of the cabinet 100.

In greater detail, the closure device 1 comprises a guide 2, preferably realized in the form of a rigid profiled element (for example of metal) and attached to the support structure 101 of the cabinet 100, preferably to a back portion of the support structure 101. The guide 2, of rectilinear form, is arranged preferably in a vertical direction as illustrated in the accompanying drawings.

Figure 3:
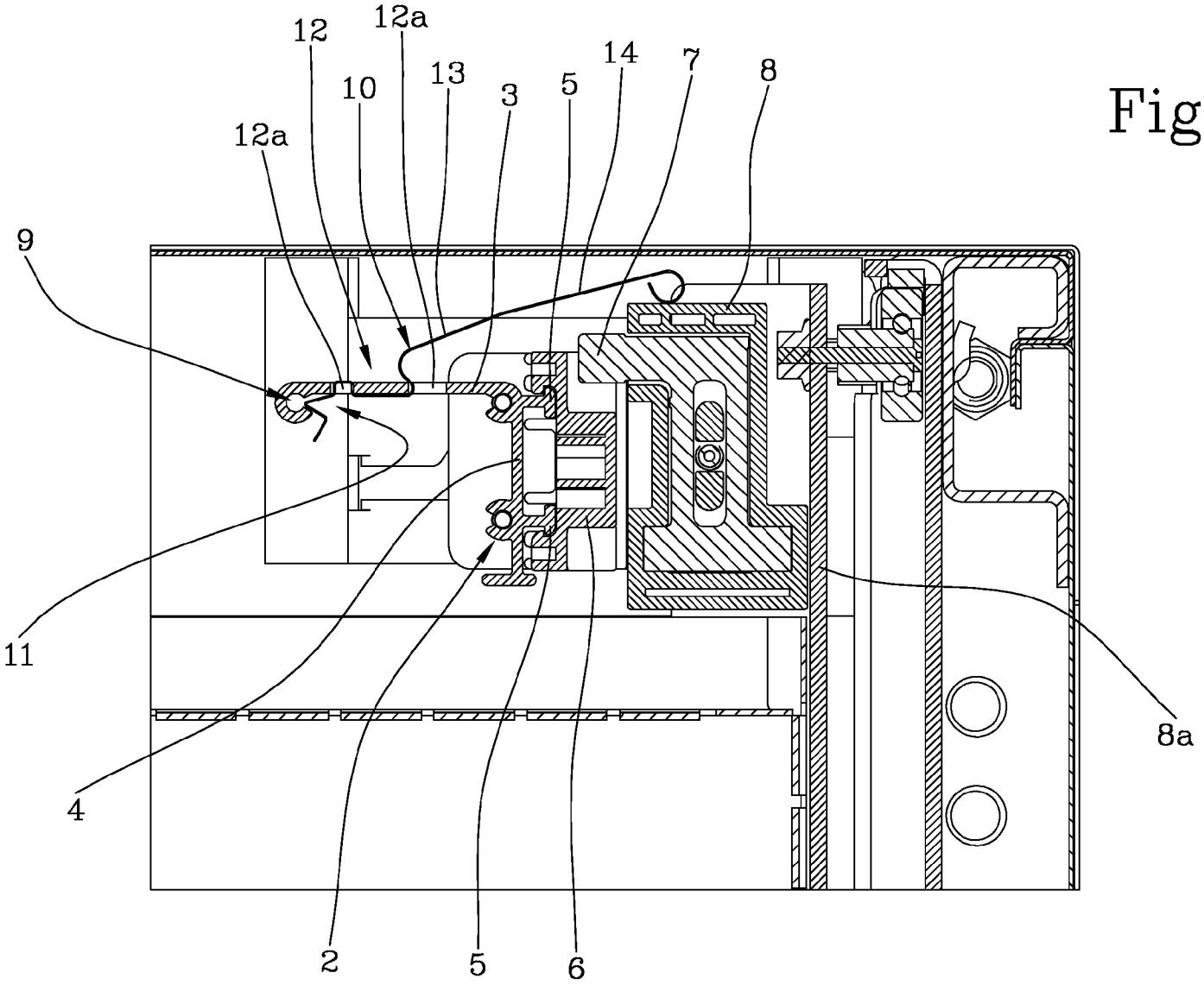
FIG. 3 represents a view in section, according to a horizontal plane, of the part of device of FIG. 2 in a configuration of closed drawers.

In the embodiment illustrated and as is visible in FIG. 3, the guide, in transverse section according to a horizontal plane, has two walls 3, 4 perpendicular to each other, the first of which 3 is arranged parallel to the rear wall 101*a* of the support structure 101.

The closure device 1 comprises furthermore a plurality of cam elements 6 slidably coupled to the guide 2 and arranged in a vertically stacked configuration along the guide 2.

In the embodiment illustrated and as is visible in FIG. 3, the cam elements 6 are slidably attached to the second 4 of the two walls 3, 4 of the guide 2. In particular the cam elements 6 are attached in cantilever to the above-mentioned second wall 4 of the guide 2 by means of a sliding connection, for example of dovetail type or equivalent (in the embodiment illustrated in FIG. 3 this sliding connection comprises two protrusions 5 projecting from the second wall 4 of the guide 2 and inserted into respective recesses in the cam elements 6 in such a way as to stably restrain the latter in a sliding relationship with respect to the guide 2).

The closure device 1 comprises furthermore, for each drawer 102, at least one activating pin 7 (only one in the embodiment illustrated because of the presence of a single guide 2 and of a single row of cam elements 6) which is inserted into a respective containment member 8 integral with the drawer 102. For example the containment member 8 is preferably fixed to the drawer 102 by the interposition of a support element 8*a* (FIGS. 3, 6, 7) fixed to the drawer 102 and slidably coupled to the guide 103.

Preferably, the activating pin 7 can pivot in the respective containment member 8 in freely rotatable manner around a horizontal axis, and faces out from the containment member 8 to engage with a respective cam element 6. In this way the activating pin 7 is movable by pivoting around the above-mentioned horizontal axis and can thus assume different heights to effect a mode of operation which will be described below. Alternatively, the activating pin 7 can be rigidly fixed to the drawer 102.

In particular, each cam element 6 is shaped in such a way as to convert a movement of the respective activating pin 7 in a direction transverse (preferably perpendicular) to the guide 2 into a corresponding movement of the cam element 6 along the guide 2 in a movement towards/away from an adjacent cam element 6.

In other words, the cam elements 6 have respective inclined contact surfaces shaped in such a way that a horizontal movement of the activating pin 7 towards the cam elements 6, from both sides, determines a mutual separation of two cam elements 6. This separation, where not obstructed, allows the activating pin 7 to pass through the stack of cam elements 6, arriving at an opening or closing configuration of the respective drawer 102 to which it is attached. These inclined contact surfaces are therefore formed on both front and rear sides of the cam elements 6.

Figure 4:
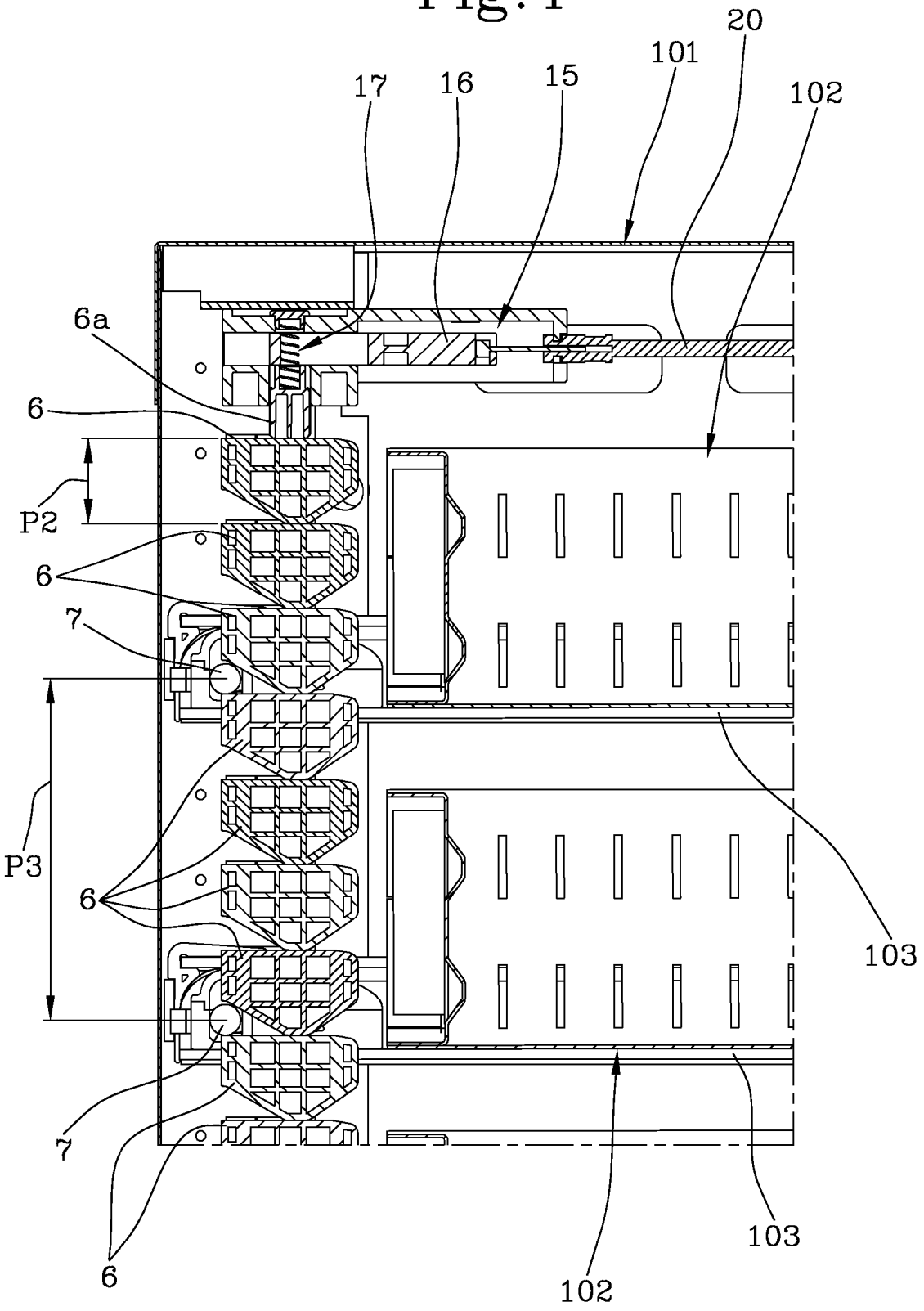
FIG. 4 represents a view in section, according to a vertical plane, of the part of device of FIG. 2 in a configuration of closed drawers.
Figure 5:
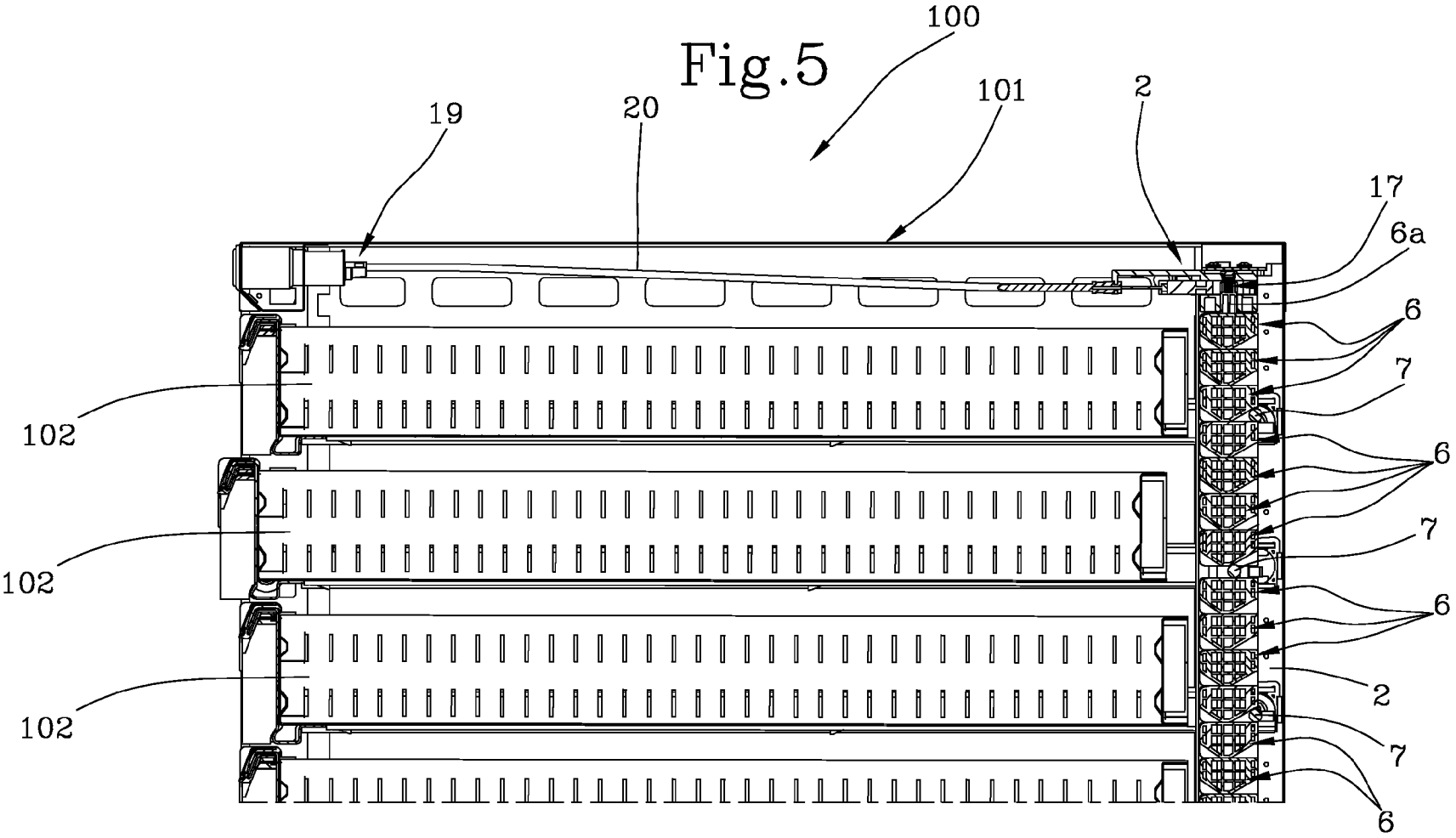
FIG. 5 represents a view in section, according to a vertical plane, of the cabinet of FIG. 1 in a configuration of opening a drawer.

In particular FIG. 4 shows a configuration of closed drawers 102, with the activating pins 7 all arranged at the rear of the stack of cam elements 6. An opening action exerted by a user on a drawer 102 forces the respective activating pin 7 to lift the respective cam element 6, creating the simultaneous lifting of all the cam elements 6 above. In this way the cam elements 6 do not offer a resistance such as to prevent the activating pin 7 from passing through the cam elements 6, and the drawer 102 opens.

The same lifting action is exerted by the activating pin 7 during a closing movement of the drawer 102.

Figure 7:
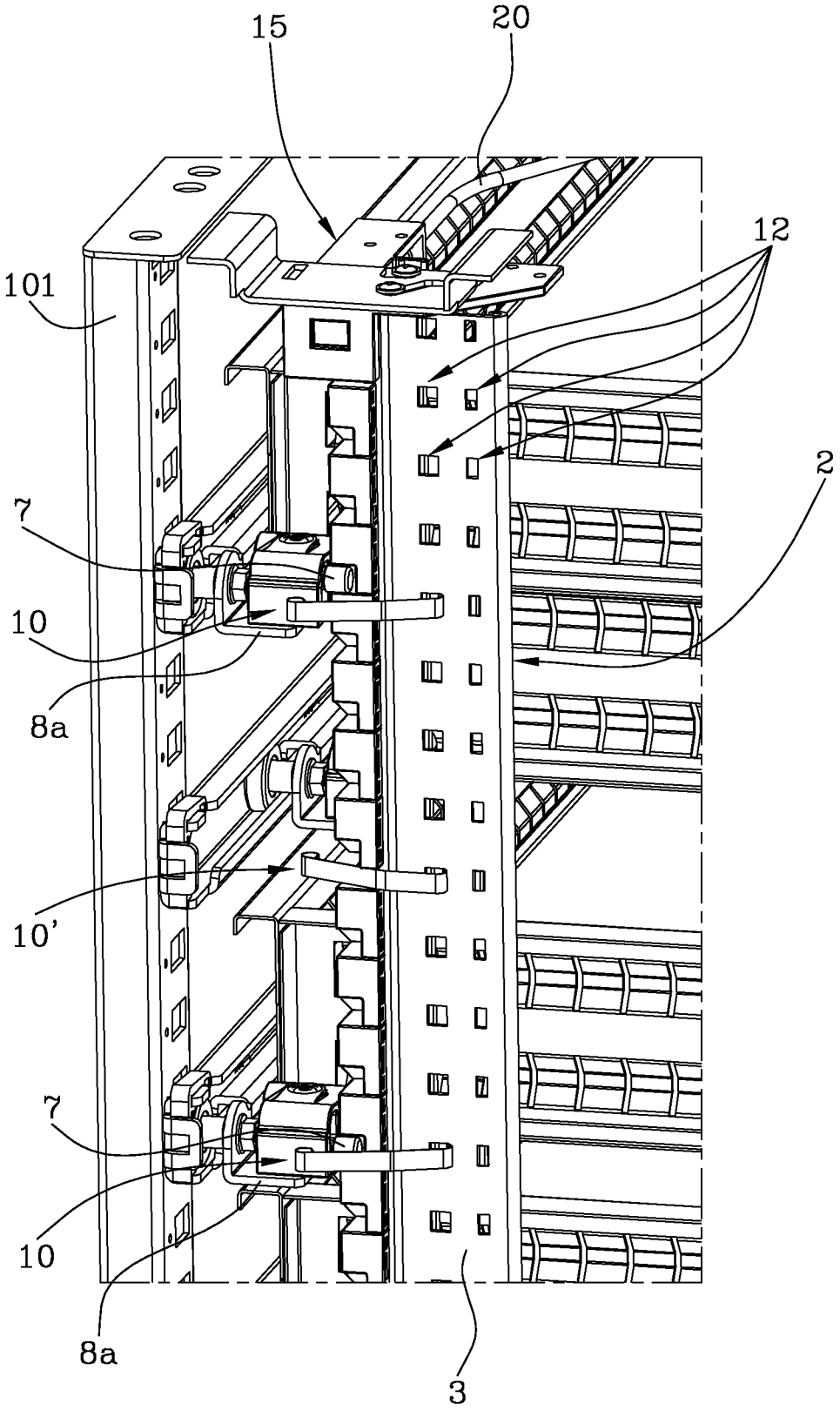
Figure 8:
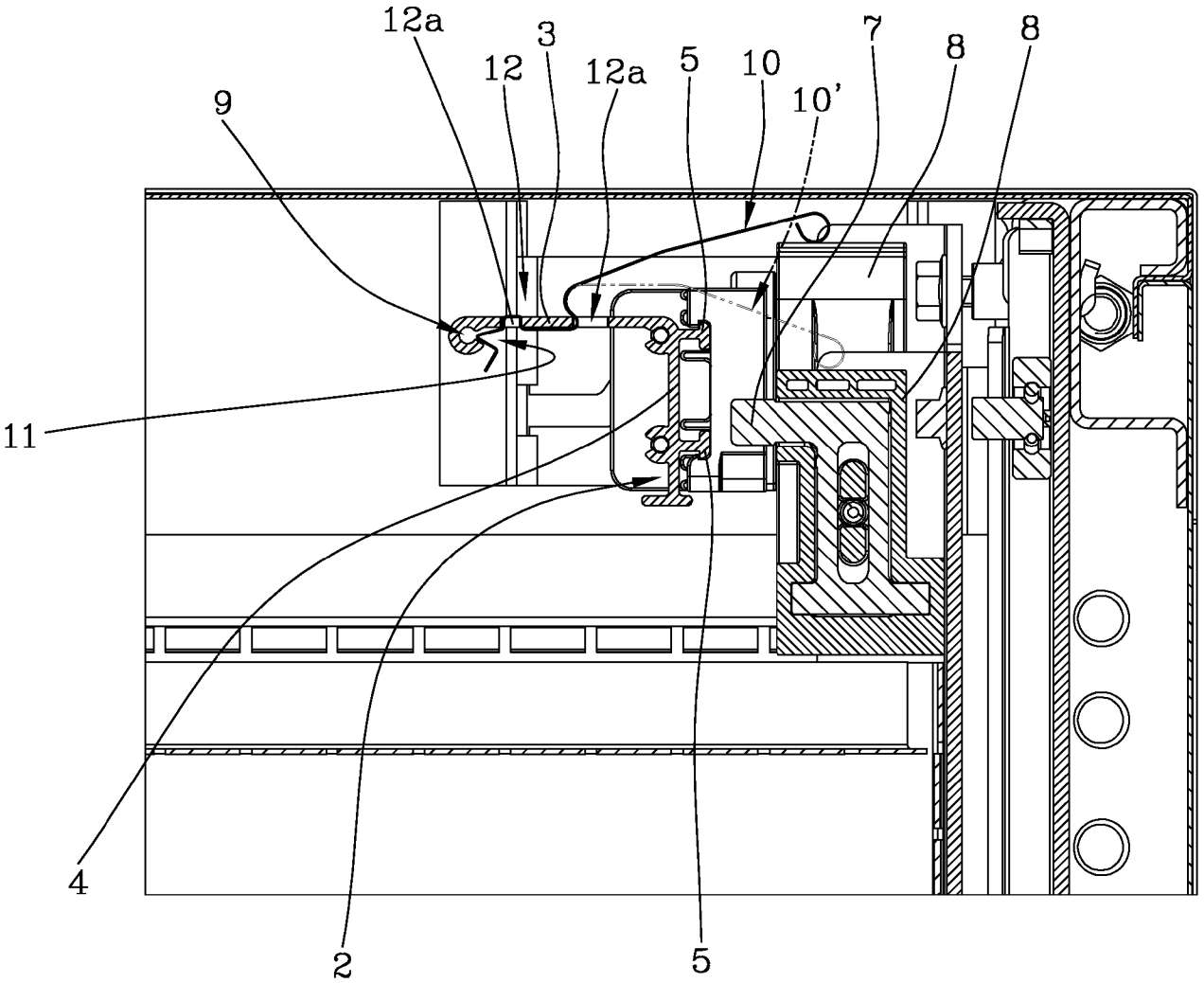
FIG. 8 represents the same view in section as FIG. 3 but in a different operating configuration, in particular of opening a drawer.

The closure device 1 comprises furthermore a plurality of separator elements 10 cooperating with the cam elements 6 and each of them being movable between an operating position 10' (illustrated in FIG. 7 and, with a broken line, in FIG. 8), in which it is arranged between two respective cam elements 6, keeping the two cam elements 6 spaced apart from each other, and an inoperative position (FIGS. 3 and 8), in which it is arranged away from a zone of mutual contact between the two respective cam elements 6 to allow a movement towards each other (i.e. an abutment or contact) between the two respective cam elements 6. In particular, FIG. 8 shows two different separator elements 10, 10', consecutive with each other but only one of them (indicated by 10' in FIGS. 7 and 8) arranged in the operating position, which makes visible the spacer element below it (indicated by 10 in FIG. 8) which is arranged in an inoperative position.

Figure 6:
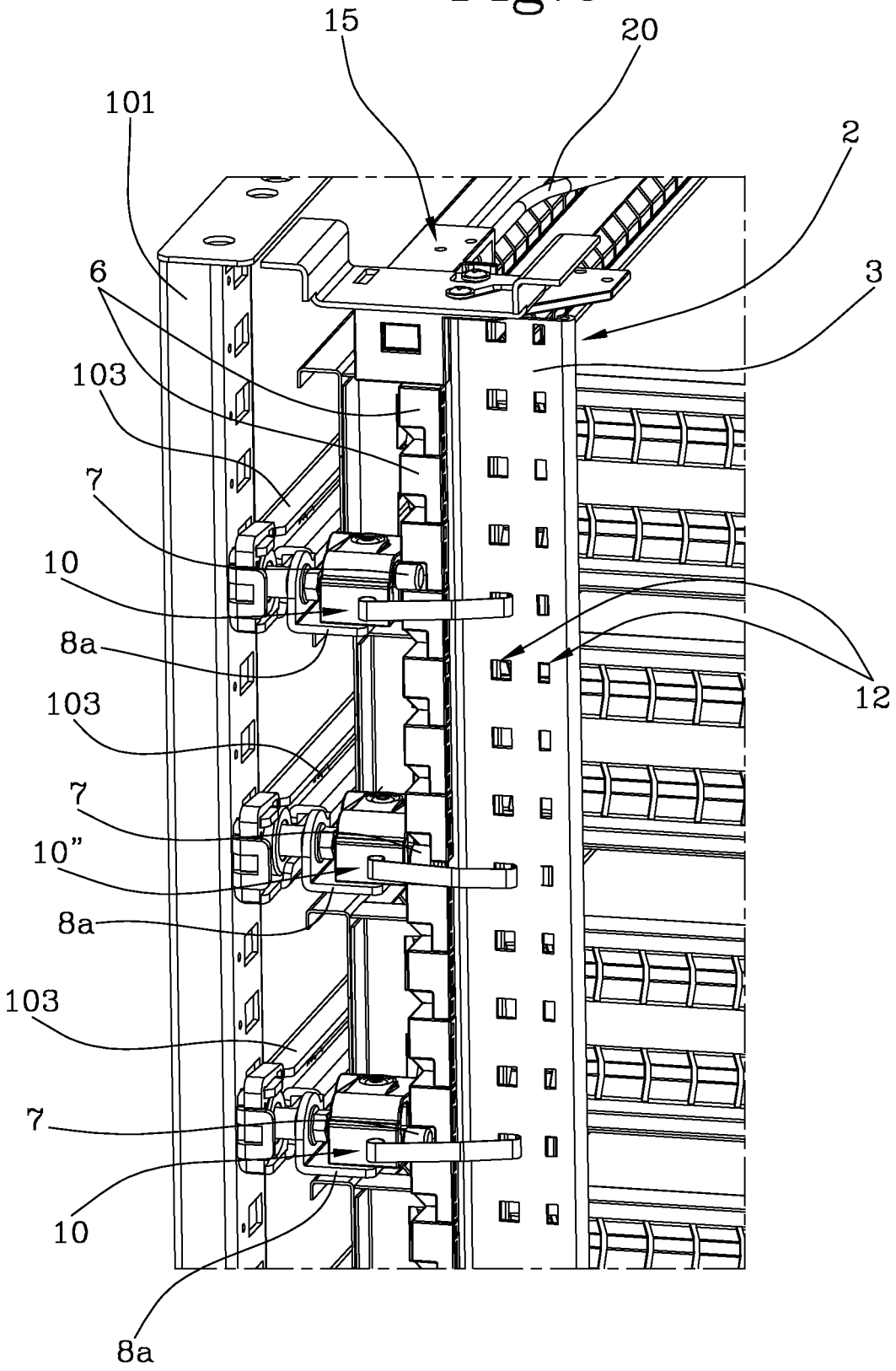
FIGS. 6 and 7 represent a rear view of the part of device of FIG. 2 in two different operating positions.

In FIG. 6 on the other hand an intermediate position is shown of the separator element (indicated with the reference 10") comprised between the operating and inoperative positions.

Advantageously, the separator elements 10 are elastically deformable between the operating and inoperative positions and, in one embodiment, they are realized in the shape of an elastically deformable tongue. In greater detail, each separator element 10 is made up of a plate, preferably metal, suitably bent to form at least one elastic connection portion 11. Preferably, the bent metal plate has generatrices parallel to the sliding direction of the cam elements 6 in the guide 2. In other words, the metal plate has a prevalent surface of extension which is upright and therefore arranged in such a way as to have its own thickness facing upwards and downwards. In this configuration the plate is bent according to a line lying on a horizontal plane.

Advantageously, the elastic connection portion 11 is stably attachable between a respective receiving portion 12 created on the guide 2, in particular on the first wall 3, in such a way as to create a stable and manually releasable snap coupling. In the embodiment illustrated and clearly visible in FIGS. 3 and 6, the above-mentioned receiving portion 12 is formed by a pair of openings 12*a* of preferably rectangular or square shape, a first of which is passed through by the separator element 10 while the second of which is engaged by a relief on the elastic connecting portion, and by a housing 9 into which is inserted a wedge-shaped protrusion on the elastic connecting portion, the latter forming the real snap connection of the separator element 10 to the first wall 3 of the guide 2.

Preferably, each metal plate forming a separator element 10 is furthermore suitably bent in such a way as to form a first stretch 13, substantially parallel (in undeformed position, FIG. 8) to the first wall 3 of the guide 2, and a second stretch 14 inclined with respect to the first stretch 13 and facing towards the stack of cam elements 6 in such a way that, in the inoperative position, the free end of the plate (opposite to the elastic connection portion 11) is situated in contact against the activating pin 7 or, more preferably, against the respective containment member 8.

In other words, the separator elements 10, in the inoperative position, are elastically deformed under a thrusting action exerted by the respective activating pins 7 (or, in the respective form illustrated, by the corresponding containment organ 8) in such a way that the separator elements 10 tend to be brought spontaneously, due to elastic return, into the operating position once the thrusting action exerted by the respective activating pins 7 (or containment members 8) has been released.

The closure device 1 is configured in such a way that the approaching movement of the separator element 10, which follows the movement of the containment member 8 and therefore that of the activating pin 7, is preceded by a separation action of the two respective cam elements 6 due to the action of said activating pin 7.

Preferably, furthermore, each activating pin 7 has a maximum dimension, measured along the direction of translation of the cam elements 6 (preferably one diameter) greater than the corresponding height of the separator element 10 in such a way as to promote the insertion of the separator element between two consecutive cam elements 6 previously separated by the activating pin 7.

Advantageously, the guide 2 has a plurality of receiving portions 12 (in the form of preferably rectangular or square apertures 12*a* and housings 9) each suitable for receiving a respective separator element 10 for creating a stable connection of the separator element 10 to the guide 2. The receiving portions 12 are distributed, preferably uniformly, along the prevalent direction of extension of the guide 2 (that is to say the direction of sliding of the cam elements 6) in such a way that at each cam element 6 there is at least one receiving portion 12.

Preferably, the receiving portions 12 of the guide 2 are spaced apart from each other, along the direction of translation of the cam elements 6, by a pitch "p1" equal to a multiple, a submultiple or having the identical same value as the height "p2" of the cam elements 6.

For reasons of flexibility of use, the height "p2" of the cam elements 6 is constant and selected preferably in such a way as to be a submultiple of the pitch "p3" between the activating pins 7 and, therefore, of the height of the drawers 102 so that as the height of the drawer 102 used varies, the engagement of specific cam elements 6 rather than others is effected.

In accordance with the invention, the separator elements 10 are provided solely at those receiving portions 12 of the guide 2 arranged at the cam elements 6 on which the activating pins 7 act.

The number of the separator elements 10 is therefore equal to the number of the activating pins 7 and equal to or less than the number of the cam elements 6. In an optimal configuration, the number of the separator elements 10 is less than the number of the cam elements 6.

Figure 10:
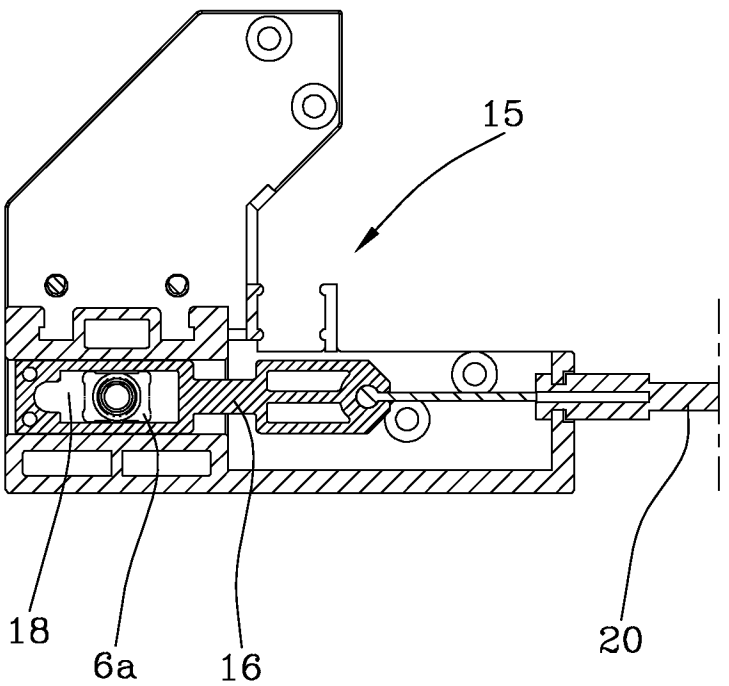
FIGS. 10 and 12 represent three-dimensional views corresponding to the views respectively of FIGS. 9 and 11.

For the purpose of allowing or preventing the opening of a drawer 102, the closure device 1 comprises furthermore locking means 15, configurable in at least one release position (FIGS. 9 and 10) wherein they allow lifting of a cam element 6 through a stroke sufficient to allow the relative activating pin 7 to go past this cam element 6, and a locking position (FIGS. 11 and 12) wherein they prevent lifting of the cam element 6 through the above-mentioned stroke, thus preventing any activating pin 7 from passing through the stack of cam elements 6 and preventing the opening of any drawer 102.

The locking means 15 comprise for example a translating piece 16 movable between the above-mentioned locking and releasing positions in such a way that, in the locking configuration (FIGS. 11 and 12), the translating piece 16 forms an upper stop element for the stacked cam elements 6, preventing a complete lifting movement (i.e. sufficient for an activating pin 7 to pass through) of the cam elements 6 and therefore a movement of opening a drawer 102. In other words, the translating piece 16 is interposed, in the locking position, between the top cam element 6 (or an auxiliary element 6*a* attached to it or integral with it as is visible in FIG. 4) and an upper abutment surface fixed with respect to the support structure 101.

Figure 2:
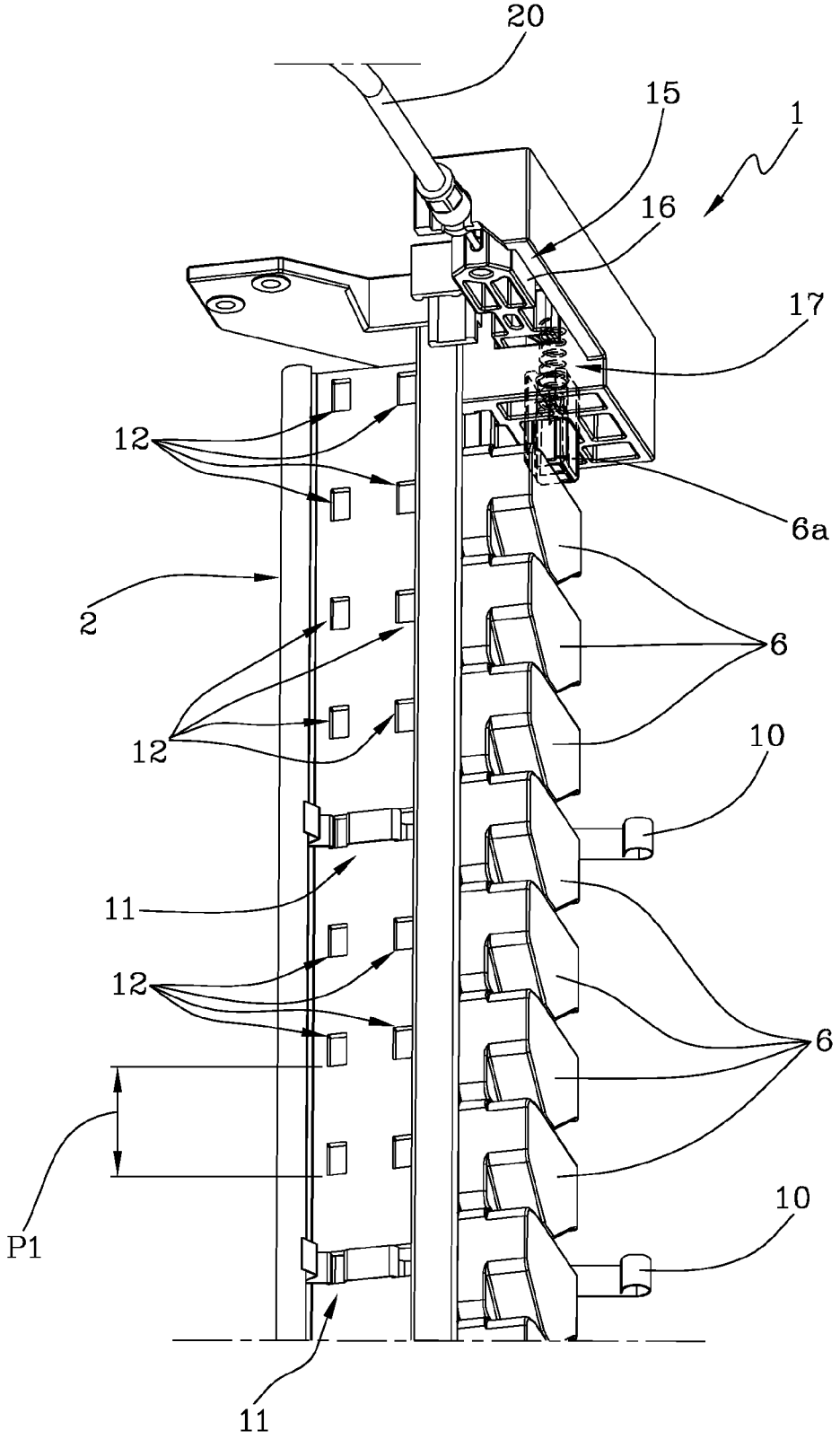
FIG. 2 shows a view of the front side of a part of the closure device according to the present invention.

In order to promote a thrust downwards onto the cam elements 6, aimed at effecting a mutual compaction, an opposing spring 17 is provided, visible for example in FIG. 2 or in FIG. 4. This opposing spring 17 acts on the auxiliary element 6 (or on the top cam element 6) which, as is visible in FIG. 4, functions as a containment cup for the lower portion of the spring 17.

The direction of translation of the translating piece 16 is horizontal and, therefore, perpendicular to the direction of lifting and lowering of the cam elements 6.

Preferably, the translating piece 16 is subject to the action of a respective opposing spring (not illustrated) which keeps the translating piece 16 pressed in the locking position.

Figure 9:
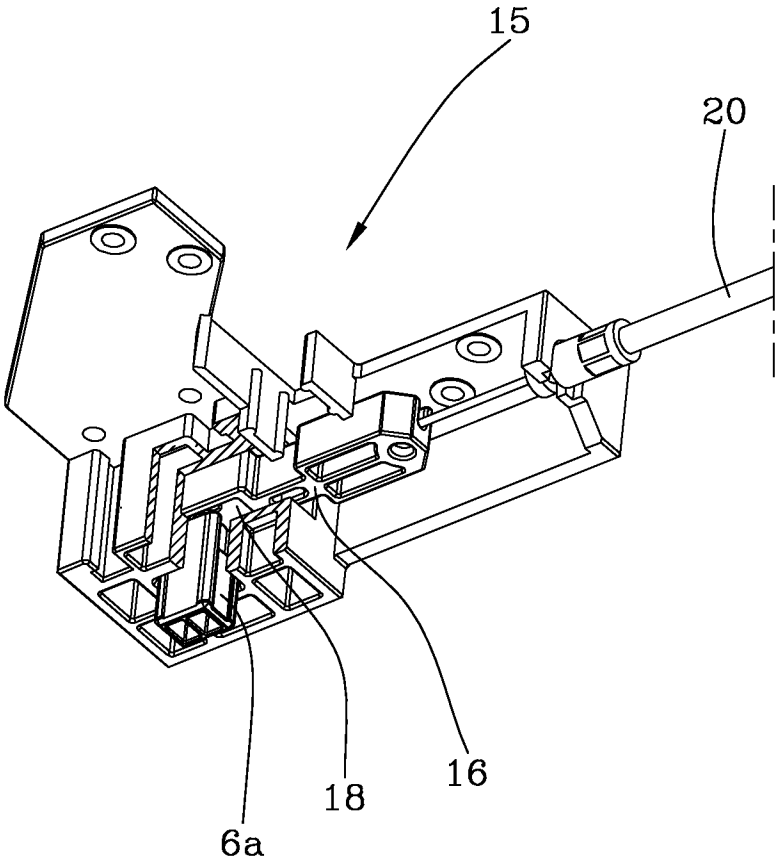
FIGS. 9 and 11 represent views in section, according to a horizontal plane and looking upwards, of the locking mechanism of the closure device according to the present invention in accordance with two different operating positions, respectively of releasing and of locking.
Figure 11:
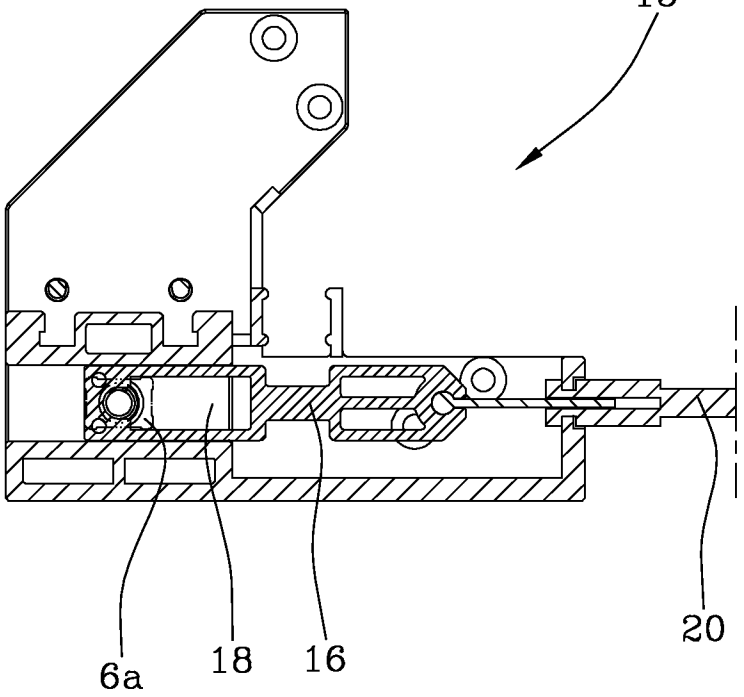
Figure 12:
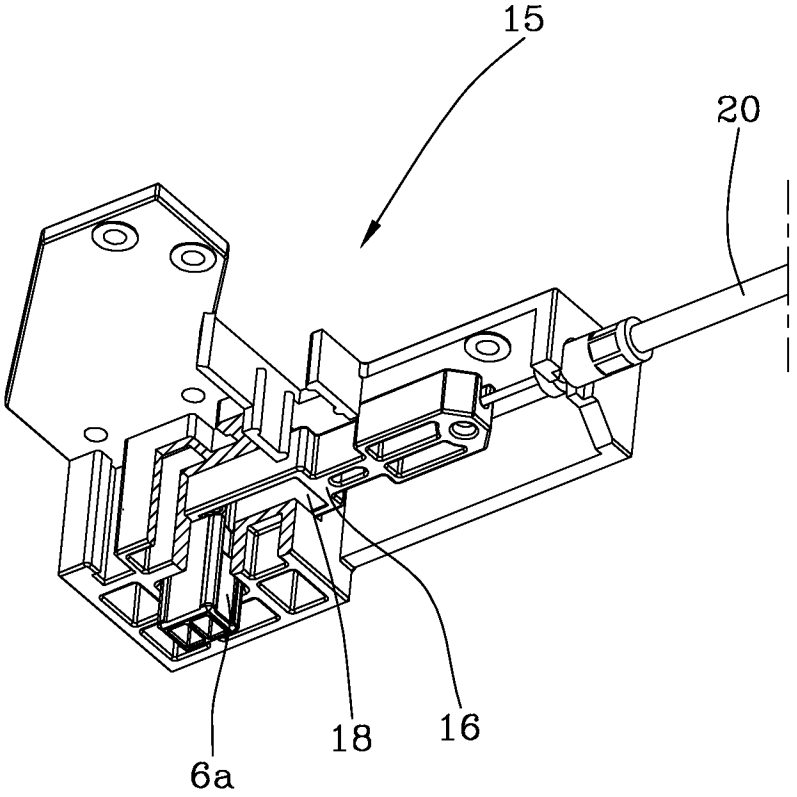

In the embodiment illustrated, and as is visible in FIGS. 9 and 11, the translating piece 16 has a central opening 18 into which the auxiliary element 6*a* is slidably insertable in the release position while, in the locking position, the translating piece 16 is situated in a backward position with respect to the release position in such a way that the auxiliary element 6*a* is not insertable into the central aperture 18 of the translating piece 16.

The closure system 1 comprises furthermore activation means, schematized comprehensively with 19 in FIG. 1, activatable by the command of an operator and active on the locking means 15 to switch (or, more generally, to move) the locking means 2 between the locking and release positions.

These activation means 19 are configured to assume an opening position, corresponding to the release position of the locking means 15, and a closure position corresponding to the locking position of the locking means 15. In other words, the activation means 19 constitute the means on which the operator actually acts to give a locking/release command to the locking means 15 (or at least to give a release command).

Preferably, as illustrated in FIG. 1, the activation means 19 comprise a push-button equipped with a lock attached to the front of the drawer cabinet 100 and connected, by means of a wire slidable inside a sheath 20, with the above-mentioned translating piece 16 to thrust the translating piece 16 into the release position against the opposing action of the spring (not illustrated) acting on the translating piece 16.

In use, an operator acts on the activation means 19 (push-button) causing the displacement of the translating piece 16 into the release position which allows lifting of the cam elements 6. The operator can then open a drawer 102 whose sliding movement on the respective guides 103 determines a translation of the activating pin 7 for the drawer 102, which lifts the respective cam element 6 and the cam elements 6 above it.

During the engagement of the activating pin 7 with the cam elements 6, possible mutual misalignments if any are absorbed by the possibility for the activating pin 7 to pivot, displacing itself vertically.

During the translation of the activating pin 7 together with the drawer 102 and together with the relative containment member 8, the respective separator element 10 is brought progressively towards the operating position by elastic return.

Once the position is reached of maximum lifting of the cam elements 6, subsequent advancement of the activating pin 7 together with the drawer 102 brings about engagement of the separator element 10 between the two cam elements 6 previously separated by the activating pin 7. The complete retraction of the activating pin 7 from the guide 2 enables the raised cam elements 6 to be arranged resting on the separator element 10 which is stably held, and in a substantially undeformed position (therefore elastically unloaded), in the operating position, or alternatively only partially undeformed (only partially unloaded), in the operating position.

The closure movement of the drawer 102 brings the activating pin 7 to engage once more with the two separated cam elements 6 and, preferably, to cause a further slight lifting to interrupt the compression on the separator element 10 by the cam elements 6.

Even in this circumstance the engagement of the activating pin 7 with the cam elements 6 is facilitated by the possibility of self-regulation if necessary by the pivoting of the activating pin 7.

Subsequently the progressive closure of the drawer 102 brings the containment member 8 (or the activating pin 7) to press against the separator element 10 bringing it towards the inoperative position and subjecting it to elastic flexion, until the position of complete closure is reached.

In accordance with the invention described above, the cam elements 6 can have any shape, it being sufficient that they are shaped in such a way (for example having special inclined or curved surfaces) that engagement in a transverse direction by the activating pin 7 brings about a lifting or a lowering thereof.

Preferably, furthermore, all the stacked cam elements 6 are identical to each other, given that it is not necessary to differentiate them depending on the specific structure (and height) of the drawers 102 used.

The present invention achieves the proposed objects, overcoming the disadvantages complained of in the known art.

The fact that the separator elements are attached to the guide and not to the cam elements makes it possible to considerably simplify the shape of the cam elements. This simplified shape, in fact, has only to satisfy the requirements of translatability along the guide and a cam engagement with the respective activating pin, with further reduction in production costs. Furthermore, the specific elastic plate conformation of the spacing elements is constructionally very simple and cheap to effect.

The adoption of a guide equipped with receiving portions having a pitch equal to a submultiple of the pitch between the activating pins, therefore equal to a submultiple of the standard height of the drawers, enables a simple reconfiguration of the closure device to adapt it to drawer cabinets with a vast range of types (and heights) of drawers without moreover altering the structure of the guide and the cam elements. It is in fact necessary from time to time, depending on requirements, to attach the separator elements to the receiving portions only corresponding to the activating pins of the configuration to be obtained, without complicated replacements of the cam elements. This makes it possible to stock in the warehouse a limited number of standard components (the cam elements are all the same, as are the separator elements), resulting in containment of production and storage costs.

If the above requirements are satisfied, assembly costs are also reduced. Since the movement of the cam elements is only translational along the guide, it is also possible to make a saving in the play between the cam elements.

Finally, it has been established that the device according to the invention makes little noise.

The invention claimed is:

1. A closure device for a drawer cabinet, comprising:

a guide (2);

a plurality of cam elements (6) slidably coupled to said guide (2) and arranged in a stacked configuration along said guide (2), each one of said cam elements (6) being configured in such a manner as to convert the movement of a respective activating pin (7) of a drawer (102) in a direction transverse to said guide (2) into a corresponding movement of the cam element (6) along the guide (2) towards or away from an adjacent cam element (6);

a plurality of spacer elements (10) that cooperate with said cam elements (6) and each one of which being movable between an operating position, wherein the spacer element is arranged between two respective cam elements (6) to keep the two cam elements (6) spaced apart from each other, and an inoperative position, wherein the spacer element is arranged away from a zone of mutual contact between said two respective cam elements (6) so as to enable reciprocal movement of said two respective cam elements (6) towards each other; wherein said spacer elements (10) are separated from said cam elements (6) and stably anchored to said guide (2), said spacer elements (10) comprising an elastically deformable element between said operating and inoperative positions, and wherein, in the inoperative position, said spacer elements (10) are elastically deformed by the thrusting action exerted by respective thrust members (8) associated with the respective activating pins (7), or by the activating pins (7) themselves, in such a manner that said spacer elements (10) tend to bring themselves automatically into the operating position upon release of said thrusting action.

2. The device according to claim 1, wherein the guide (2) has a plurality of receiving portions (12), each of which is suitable for receiving a respective spacer element (10) to provide a stable connection of the spacer element (10) to the guide (2), said receiving portions (12) being distributed along a prevalent direction of extension of the guide (2) in such a manner that at least one receiving portion (12) is present at each cam element (6).

3. The device according to claim 2, wherein said spacer elements (10) are applied solely to those receiving portions (12) of the guide (2) that are arranged at those cam elements (6) upon which the activating pins (7) act.

4. The device according to claim 2, wherein said receiving portions (12) of the guide (2) are spaced apart from each other by a pitch (p1) equal to a multiple or a submultiple, of a corresponding height (p2) of the cam elements (6), or having a value identical to said height (p2).

5. The device according to claim 2, wherein the cam elements (6) are identical to each other and wherein the number of spacer elements (10) is equal to the number of activating pins (7) and lower than the number of cam elements (6).

6. The device according to claim 2, wherein said receiving portions (12) of the guide (2) comprise respective seats (9) within which elastic portions (11) for connection of respective spacer elements (10) are engageable.

7. The device according to claim 6, wherein the elastic portions (11) are engageable within the respective seats (9) by snap fitting.

8. The device according to claim 1, wherein each spacer element (10) is defined by a flexible metal plate.

9. The device according to claim 1, further comprising a plurality of activating pins (7), each of which is applicable to a respective drawer (102) of said drawer cabinet (100).

10. The device according to claim 1, further comprising:

locking means (15) that can be configured in at least a releasing position, wherein it enables the lifting of a cam element (6) for a stroke sufficient to enable the relative activating pin (7) to pass beyond this cam element (6), and a locking position, wherein it prevents the lifting of said cam element (6) for the above-mentioned stroke;

activation means (19) that can be activated by means of the command of an operator and are active on said locking means (15) for moving the locking means (15) between said locking and releasing positions.

11. A drawer cabinet comprising a supporting structure (101) and a plurality of drawers (102) mounted on the supporting structure (101) and each having at least one of said activating pins (7), and further comprising a closure device (1) according to claim 1, mounted on said supporting structure (101), to provide, selectively, the opening of one of said drawers (102) at a time, and the simultaneous closure of all of said drawers (102).

12. The cabinet according to claim 11, wherein the cam elements (6) are of a height (p2) equal to a submultiple of a corresponding pitch (p3) with which the activating pins (7) applied to the drawers (102) are spaced one from the other.

13. The cabinet according to claim 11, comprising, for each activating pin (7), a containing member (8) within which there is housed the activating pin (7), wherein the containing member (8) defines a thrust member suitable for coming into contact with a respective spacer element (10) by resting thereagainst so as to press the spacer element (10) into the inoperative position during closure of the respective drawer (102).

14. The cabinet according to claim 11, wherein the activating pin (7) defines a thrust member suitable for coming into contact with a respective spacer element (10) by resting thereagainst so as to press the spacer element (10) into the inoperative position during closure of the respective drawer (102).

15. The cabinet according to claim 11, wherein the closure device (1) is mounted in a bottom portion of the supporting structure (101).

* * * * *